US011420846B2

(12) United States Patent
Gireddy

(10) Patent No.: US 11,420,846 B2
(45) Date of Patent: Aug. 23, 2022

(54) AUGMENTED REALITY CAR OPERATING PANEL

(71) Applicant: OTIS ELEVATOR COMPANY, Farmington, CT (US)

(72) Inventor: Jayapal Reddy Gireddy, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 706 days.

(21) Appl. No.: 16/352,187

(22) Filed: Mar. 13, 2019

(65) Prior Publication Data

US 2019/0284020 A1 Sep. 19, 2019

(51) Int. Cl.

| | |
|---|---|
| ***B66B 1/52*** | (2006.01) |
| ***B66B 3/00*** | (2006.01) |
| ***B66B 1/46*** | (2006.01) |

(52) U.S. Cl.

CPC ..... *B66B 1/52* (2013.01); *B66B 1/46* (2013.01); *B66B 1/461* (2013.01); *B66B 1/467* (2013.01); *B66B 1/468* (2013.01); *B66B 3/008* (2013.01); *B66B 2201/4638* (2013.01); *B66B 2201/4646* (2013.01)

(58) Field of Classification Search

CPC ..... B66B 1/468; B66B 1/3492; B66B 3/008; B66B 5/0012; B66B 1/463; B66B 1/50; B66B 2201/4607; B66B 2201/4669; B66B 1/52

See application file for complete search history.

(56) References Cited

U.S. PATENT DOCUMENTS

| | | | | |
|---|---|---|---|---|
| 4,969,700 | A | 11/1990 | Haines | |
| 6,031,519 | A | 2/2000 | O'Brien | |
| 6,161,654 | A * | 12/2000 | Sirigu | B66B 3/00 187/391 |
| 7,054,045 | B2 | 5/2006 | Mcpheters et al. | |
| 7,881,901 | B2 | 2/2011 | Fein et al. | |
| 8,089,456 | B2 | 1/2012 | Grego et al. | |
| 8,127,251 | B2 | 2/2012 | Fein et al. | |

(Continued)

FOREIGN PATENT DOCUMENTS

| | | |
|---|---|---|
| CN | 103373650 A | 10/2013 |
| CN | 204400366 U | 6/2015 |

(Continued)

OTHER PUBLICATIONS

EP Search Report; dated Sep. 24, 2019; Application No. 19162375.0; Filed: Mar. 12, 2019; 6 pages.

(Continued)

*Primary Examiner* — Marlon T Fletcher
(74) *Attorney, Agent, or Firm* — Cantor Colburn LLP

(57) ABSTRACT

An elevator system is provided. Aspects includes an elevator car, a sensor, and a projector affixed to the elevator car, wherein the projector is operated by a controller and the controller is configured to receive an indication of a presence of a passenger in the elevator car. A car operating panel is projected, by a projector, in the elevator car, wherein the car operating panel comprises a virtual element. An activation of the virtual element from the passenger is sensed by a sensor and an action is initiated based at least in part on sensing the activation of the virtual element.

20 Claims, 6 Drawing Sheets

(56) References Cited

U.S. PATENT DOCUMENTS

| | | | | |
|---|---|---|---|---|
| 8,212,768 | B2 | 7/2012 | Fein et al. | |
| 8,477,098 | B2 | 7/2013 | Fein et al. | |
| 8,500,284 | B2 | 8/2013 | Rotschild et al. | |
| 8,514,194 | B2 | 8/2013 | Lawrence et al. | |
| 8,547,327 | B2 | 10/2013 | Clarkson et al. | |
| 9,268,146 | B2 | 2/2016 | Iwasawa et al. | |
| 9,773,345 | B2 | 9/2017 | Stirbu et al. | |
| 10,732,721 | B1 * | 8/2020 | Clements | G06F 3/167 |
| 2005/0277467 | A1 | 12/2005 | Karabin et al. | |
| 2010/0253700 | A1 | 10/2010 | Bergeron | |
| 2013/0220740 | A1 * | 8/2013 | Yoo | B66B 1/34 187/380 |
| 2015/0266700 | A1 * | 9/2015 | Salmikuukka | B66B 1/467 187/380 |
| 2016/0147308 | A1 | 5/2016 | Gelman et al. | |
| 2016/0200547 | A1 * | 7/2016 | Nagata | B66B 1/468 187/380 |
| 2016/0306817 | A1 | 10/2016 | Heilig et al. | |
| 2017/0313546 | A1 | 11/2017 | King | |
| 2018/0086595 | A1 * | 3/2018 | Guillot | B66B 3/00 |
| 2018/0111792 | A1 * | 4/2018 | Schach | B66B 5/0012 |
| 2019/0066681 | A1 * | 2/2019 | Hsu | B66B 1/3461 |
| 2019/0284020 | A1 * | 9/2019 | Gireddy | B66B 3/008 |
| 2021/0206598 | A1 * | 7/2021 | Roth | B66B 1/468 |
| 2021/0214185 | A1 * | 7/2021 | Hiltunen | B66B 3/006 |

FOREIGN PATENT DOCUMENTS

| | | | |
|---|---|---|---|
| CN | 204416809 | U | 6/2015 |
| CN | 204802795 | U | 11/2015 |
| CN | 105197702 | A | 12/2015 |
| CN | 105967019 | A | 9/2016 |
| CN | 205634507 | U | 10/2016 |
| CN | 205953247 | U | 2/2017 |
| JP | 2008013299 | A | 1/2008 |
| JP | 2010143683 | A | 7/2010 |
| KR | 20070099783 | A | 10/2007 |
| WO | 05113399 | A1 | 12/2005 |

OTHER PUBLICATIONS

IN Office Action; dated Mar. 25, 2021; Application No. 201811009167; Filed: Mar. 1, 2019; 4 pages.

European Examination Report for Application No. 19162375.0; dated Feb. 22, 2022; 5 Pages.

* cited by examiner

AUGMENTED REALITY CAR OPERATING PANEL

CROSS-REFERENCE TO RELATED APPLICATIONS

This application claims the benefit of Indian provisional application no. 201811009167 filed Mar. 13, 2018, which is incorporated herein by reference in its entirety.

BACKGROUND

The subject matter disclosed herein generally relates to elevator systems and, more particularly, to an augmented reality car operating panel.

Elevator systems typically include a car operating panel (COP) utilized for operation of the elevator car. The car operating panel receives elevator passenger inputs that can then designate a desired floor, hold open or close the elevator car doors, sound an alarm, and the like. Car operating panels utilizing buttons and touch based systems have a variety of issues that present themselves overtime such as, for example, wear and tear of buttons, loss of touch sensitivity over time, regular service and cleaning is required, cost ineffectiveness, reduced passenger experience, power consumption, and hygienic issues as physical touch is required.

BRIEF DESCRIPTION

According to one embodiment, an elevator system is provided. The elevator system includes an elevator car, a sensor, and a projector affixed to the elevator car, wherein the projector is operated by a controller and the controller is configured to receive an indication of a presence of a passenger in the elevator car. A car operating panel is projected, by a projector, in the elevator car, wherein the car operating panel comprises a virtual element. An activation of the virtual element from the passenger is sensed by a sensor and an action is initiated based at least in part on sensing the activation of the virtual element.

In addition to one or more of the features described above, or as an alternative, further embodiments of the elevator system may include that the action comprises initiating an elevator command for the elevator car.

In addition to one or more of the features described above, or as an alternative, further embodiments of the elevator system may include that the action comprises adding, by the controller, a second virtual element to the car operating panel and projecting, by the projector, the second virtual element in the car operating panel.

In addition to one or more of the features described above, or as an alternative, further embodiments of the elevator system may include that the activation of the virtual element from the passenger comprises engaging, by the passenger, a region in the virtual element for a duration of time.

In addition to one or more of the features described above, or as an alternative, further embodiments of the elevator system may include that the activation of the virtual element from the passenger comprises engaging, by the passenger, a region in the virtual element utilizing a movement pattern.

In addition to one or more of the features described above, or as an alternative, further embodiments of the elevator system may include that the virtual element comprises a first color and responsive to sensing the activation of the virtual element from the passenger, the virtual element changes to a second color.

In addition to one or more of the features described above, or as an alternative, further embodiments of the elevator system may include that the controller is further configured to periodically detect, by the sensor, the presence of the passenger and responsive to the passenger exiting the elevator car, initiating a power savings mode for the car operating panel.

In addition to one or more of the features described above, or as an alternative, further embodiments of the elevator system may include that the car operating panel is projected on to a surface of the elevator car.

In addition to one or more of the features described above, or as an alternative, further embodiments of the elevator system may include that the car operating panel comprises a first mode and a second mode and wherein the first mode comprises a minimal display of the virtual element and wherein the second mode comprises a descriptive display of the virtual element.

In addition to one or more of the features described above, or as an alternative, further embodiments of the elevator system may include that the initiating the action comprises projecting, by the projector, the second mode for the car operating panel.

In addition to one or more of the features described above, or as an alternative, further embodiments of the elevator system may include that the controller is further operable to determine a location of the passenger in the elevator car and the car operating panel is projected to a second location proximate to the location of the passenger.

In addition to one or more of the features described above, or as an alternative, further embodiments of the elevator system may include that the car operating panel further comprises a news feed.

In addition to one or more of the features described above, or as an alternative, further embodiments of the elevator system may include a microphone, the microphone is operated by the controller and the controller is further configured to receive an audio command from the user and responsive to the audio command from the user, initiate a second action for the elevator car.

According to one embodiment, a computer-implemented method for operating an elevator system is provided. The method includes receiving an indication of a presence of a passenger in an elevator car. A car operating panel is projected, by a projector in the elevator car and the car operating panel comprises a virtual element. An activation of the virtual element from the passenger is sensed by a sensor and an action is initiated based at least in part on sensing the activation of the virtual element.

In addition to one or more of the features described above, or as an alternative, further embodiments of the method may include that initiating the action comprises initiating an elevator command for the elevator car.

In addition to one or more of the features described above, or as an alternative, further embodiments of the method may include that initiating the action comprises adding a second virtual element to the car operating panel and projecting, by the projector, the second virtual element in the car operating panel.

In addition to one or more of the features described above, or as an alternative, further embodiments of the method may include that the activation of the virtual element from the passenger comprises engaging, by the passenger, a region in the virtual element for a duration of time.

In addition to one or more of the features described above, or as an alternative, further embodiments of the method may include that the activation of the virtual element from the passenger comprises engaging, by the passenger, a region in the virtual element utilizing a movement pattern.

In addition to one or more of the features described above, or as an alternative, further embodiments of the method may include that the virtual element comprises a first color and responsive to sensing the activation of the virtual element from the passenger, the virtual element changes to a second color.

In addition to one or more of the features described above, or as an alternative, further embodiments of the method may include periodically detecting, by the sensor, the presence of the passenger and responsive to the passenger exiting the elevator car, initiating a power savings mode for the car operating panel.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
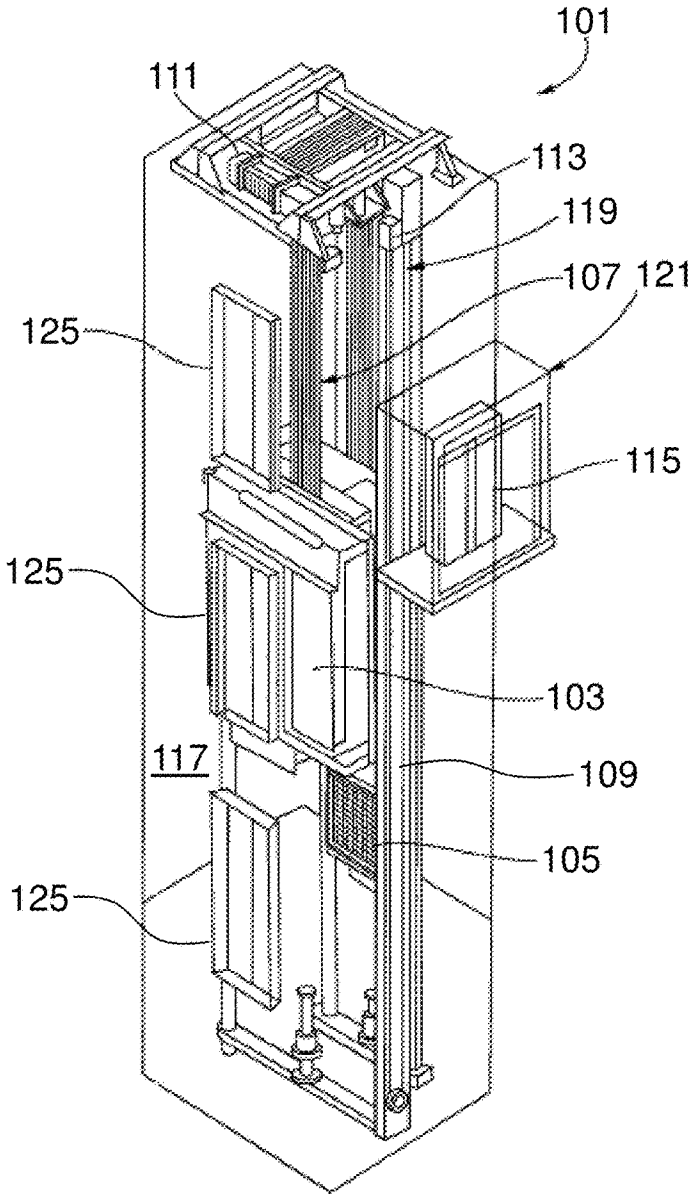
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement of the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
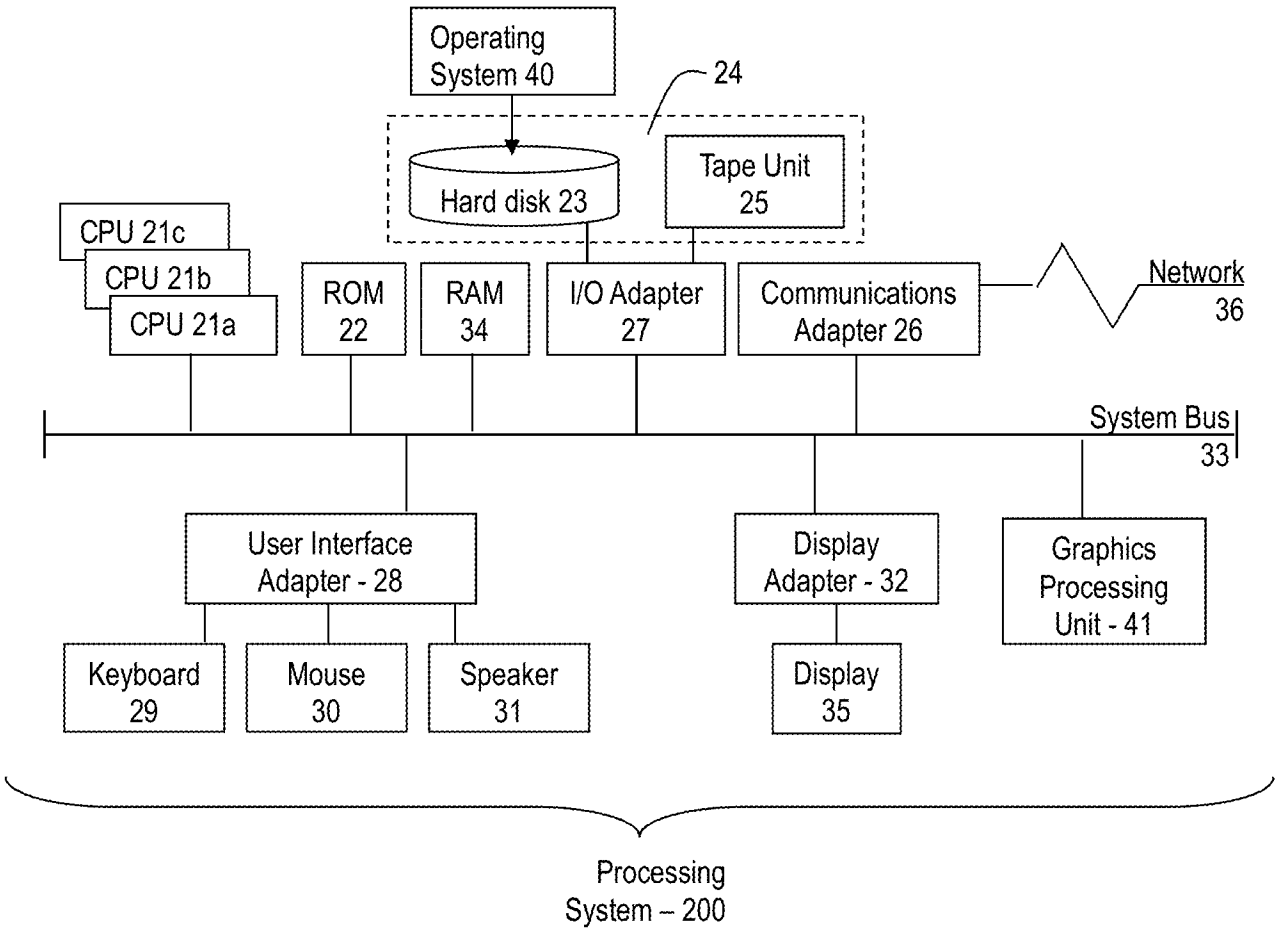
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, elevator car operating panels are typically installed on the inside of elevator cars to allow passengers to select a desired floor or select a number of options while inside the elevator car. The panels typically include electronic and mechanical buttons or switches that require a passenger to physically touch and manipulate the button or switch to activate a desired elevator command. Drawbacks to the physical touch based system for elevator car operating panels include wear and tear of buttons, loss of touch sensitivity over time, regular service and cleaning is required, cost ineffectiveness, reduced passenger experience, power consumption, and hygienic issues.

Turning now to an overview of the aspects of the disclosure, one or more embodiments address the above-described shortcomings of the prior art by providing an elevator system that utilizes augmented reality for the functionality of a car operating panel utilizing three-dimensional (3D) holography. Aspects include a holographic projection device in electronic communication with an elevator controller to receive a passenger input in an elevator car. The holographic projection device can project the car operating panel onto a surface within the elevator car or it can project the COP into the air within the elevator car. A passenger can select a floor by inputting a command into the holographic COP which is then communicated to the elevator controller.

Figure 3:
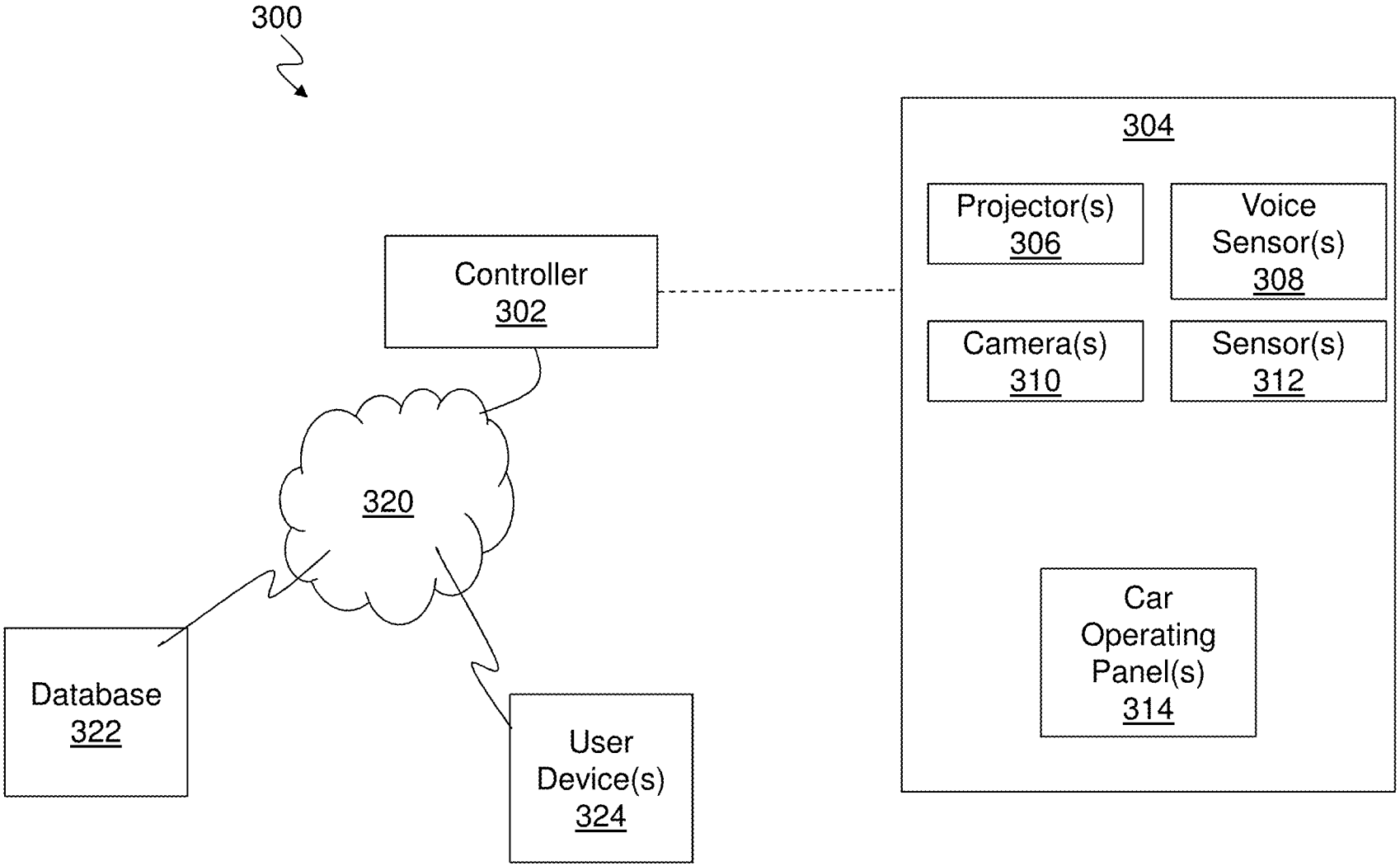
FIG. 3 depicts a block diagram of a system for an augmented reality car operating panel in an elevator according to one or more embodiments of the disclosure.

Turning now to a more detailed description of aspects of the present disclosure, FIG. 3 depicts a system 300 for an augmented reality car operating panel in an elevator. The system 300 includes an elevator car 304. The system 300 also includes a controller 302, a network 320, a database 322, and a user device 324. The elevator car 304 includes at least one projector 306, a voice sensor 308, a camera 310, and a sensor 312. The elevator car 304 also includes at least one car operating panel 314.

In one or more embodiments, the controller 302 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the controller 302 is operable to control the elevator car 304 within an elevator system. The elevator car 304 can be a part of a larger elevator bank that operates within a multi-story building with the controller 302 controlling the elevator car 304 along with multiple other elevator cars in the same building. In one or more embodiments, when a passenger enters the elevator car 304, the controller 302 can detect the presence of the passenger using any means such as, for example, a motion sensor 312 or the like. The presence of the passenger in the elevator car 304 can cause the projector 306 to project a car operating panel (COP) 314 in the elevator car 304. The COP 314 can be projected onto a surface within the elevator car 304 or the COP 314 can be projected in the air within the elevator car 304. The COP 314 can include one or more virtual elements within the projected COP. The one or more virtual elements can include virtual representations of elevator buttons, display screens, video, images, or other virtual media such as news feeds and the like.

In one or more embodiments, the virtual elements on the car operating panel 304 can be activated to engage the elevator car 304. For example, a passenger enters the elevator car and the projector 306 projects the car operating panel 314 in the elevator car 304 with virtual elevator buttons. The passenger can press at the virtual elevator buttons which causes the controller 302 to activate the elevator car 304 and deliver the passenger to a desired floor.

Figure 4:
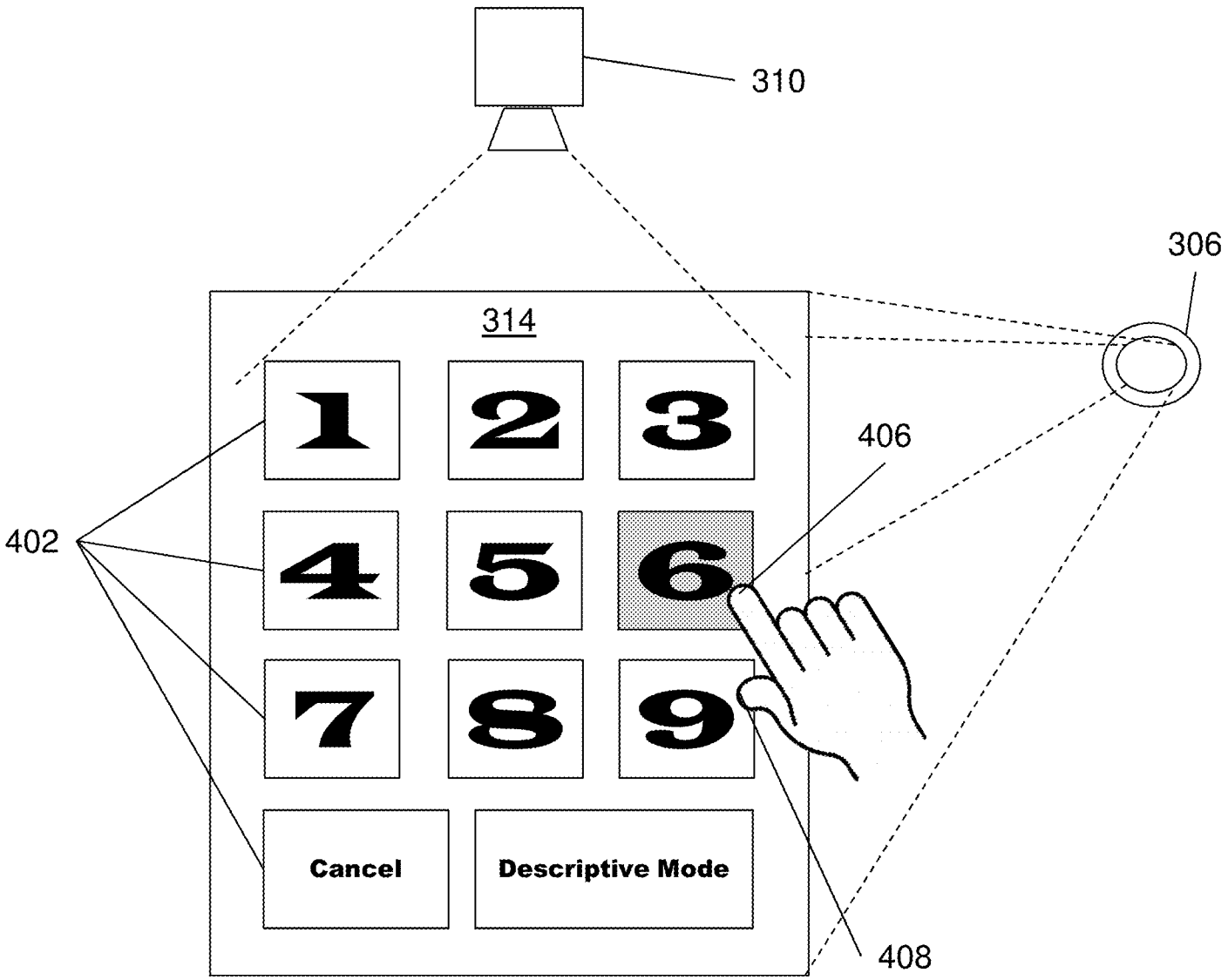
FIG. 4 depicts a car operating panel according to one or more embodiments.

FIG. 4 depicts a car operating panel according to one or more embodiments. The car operating panel 314 includes virtual elements 402. In the illustrative example, the virtual elements 402 are virtual buttons but in one or more embodiments, the virtual elements 402 can be a variety of media including images, videos, shapes, designs, themes, and the like. In one or more embodiments, a passenger can activate the elevator car 304 or change the configuration of the car operating panel 314 by activating one of the virtual elements 402. The car operating panel 314 is projected by the projector 306 and the camera 310 captures media associated with the car operating panel 314. In one or more embodiments, the camera 310 captures a passenger's hand movements with respect to the virtual elements 402 of the car operating panel 314. To activate a virtual element 402, the passenger can move his or her finger to a location 406 on the virtual element 406. In the illustrated example, the user's finger is found to be at or around the location 406 on the '6' button (e.g., virtual element) which corresponds to an elevator call to the sixth floor of a building.

In one or more embodiments, when a virtual element 402 is activated by a passenger, it can change colors, size, shape, or shading to indicate that the selection has been received or acknowledged by the car operating panel 314. In some cases, a passenger's hand might be at more than one location. In the illustrated example, the index finger of the passenger is at the first location 406 and also the passenger's thumb is shown to be at a second location 408 which corresponds to the '9' button (e.g., virtual element). The camera 310 captures the media of the passenger's hand and transmits the media to the controller 302. The controller 302, utilizing logic, can determine a confidence interval for the first location 406 and the second location 408 to determine which location (region in the virtual element) is being selected by the passenger. The locations with the highest confidence interval can be chosen as the virtual element being selected by the passenger. In the illustrative example, the '6' button is the button being selected. In one or more embodiments, if the confidence interval is below a confidence threshold, the car operating panel 314 can alert the passenger to adjust their selection by moving their hand or finger to a region more indicative of their selection. The alert could be in the form of a message text on the car operating panel 314 or the car operating panel 314 projection can be augmented in size, shape, color, or shading to alert the passenger to make another selection. While the illustrated example utilizes the camera 310 to detect a selection or activation of virtual elements 402 of the car operating panel 314, any type of sensor 312 can be utilized to detect a passenger's selection of a virtual element 402.

Figure 5:
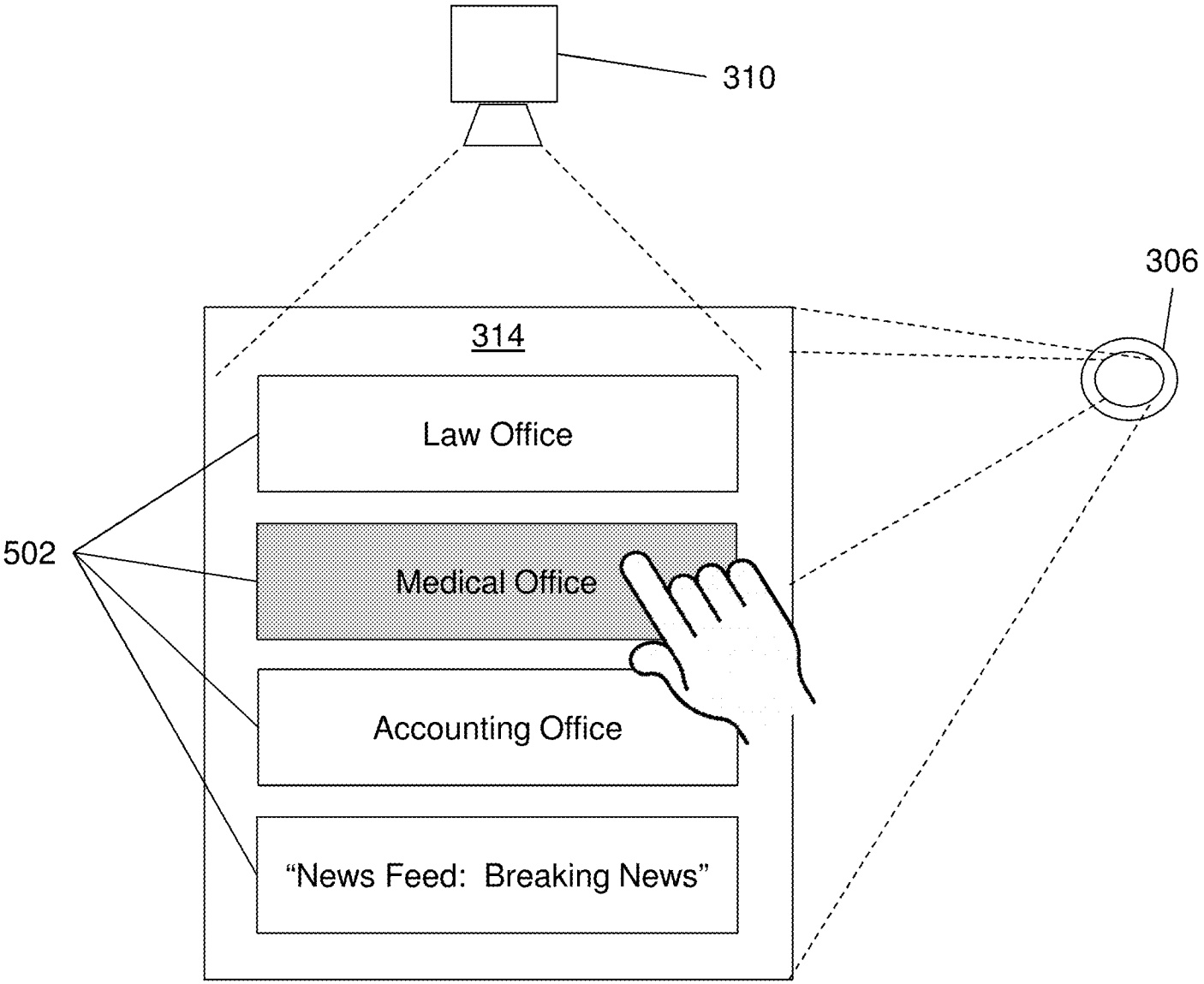
FIG. 5 depicts a car operating panel displaying descriptive virtual elements according to one or more embodiments.

In one or more embodiments, the car operating penal 314 can operate in several modes such as a first mode that displays basic virtual elements 402 such as numbering or one or two word buttons as illustrated in FIG. 4. Also, a second mode can be utilized that displays descriptive virtual elements. FIG. 5 depicts a car operating panel displaying descriptive virtual elements according to one or more embodiments. The car operating panel 314 is projected by a projector 306 with the camera 310 capturing media associated with the car operating panel 314. One or more virtual elements 502 are displayed in the car operating panel. In the illustrative example, the virtual elements 502 are descriptive indicating office tenants that can be accessed by an elevator car 304.

FIGS. 4 and 5 are illustrative of car operating panels and are not meant to limit the scope of the car operating panels. In one or more embodiments, a car operating panel 314 can display a variety of themes and virtual elements that match the themes. For example, an elevator car at an aquarium can utilize a marine theme and the virtual elements could be in the shape and color of aquatic animals. A number of themes can be stored on the database 322 and accessed through the network 320 by the controller. The user device 324 can access the themes on the database 322 and adjust the themes for the car operating panel 314 in real time. Themes for the car operating panel 314 can be scheduled throughout a day, week, month or year for special holidays or events corresponding to the building events scheduled.

In one or more embodiments, the car operating panel 314 can operate in a third mode or power savings mode. The power savings mode can turn off the projection of the car operating panel 314 or dim the lighting of the projected car operating panel 314. A car operating panel 314 can enter power savings mode when the elevator car 304 has no passengers or is in an idle mode and is not moving.

In one or more embodiments, to activate a virtual element 402, the passenger can maneuver his or her hand to a region at or near the desired virtual element. As the passenger's hand is present at the region at the virtual element for a duration of time, the virtual element is activated and the controller 402 can receive a signal indicating to engage the elevator car 304. In one or more embodiments, the passenger's hand or finger can utilize a movement pattern to activate the virtual element 402. For example, the car operating panel 314 can display multiple virtual elements 402 and a passenger can move his or her finger through the virtual element as if pushing a physical representation of the virtual element. This finger movement through the virtual element (e.g., movement pattern) can be recognized by the controller 302 to indicate activation of the virtual element.

In one or more embodiments, the car operating panel 314 can include a doodle for the associated theme of the car operating panel 314. The doodle can change periodically (e.g., hourly, daily, etc.) to resemble a specialty of a particular day. The doodle can include a search feature that allows passengers to search for tenants in the building or other searchable features for the building or region.

In one or more embodiments, the voice sensor 308 can be utilized to assist passengers that are unable to utilize the car operating panel 314. For example, a blind passenger will not be able to see the projection and can utilize voice commands to activate the elevator commands. In one or more embodiments, the projector 306 can project the car operating panel 314 on to a specific surface in the elevator car 304. The surface of the elevator car 304 can have braille engraved at regions that correspond to virtual elements of the car operating panel 314. This can assist blind passengers with activating the virtual elements to indicate a desired floor. In one or more embodiments, the camera 310 can capture hand movements and gestures from passengers that may need assistance. Image processing techniques can be utilized for gesture recognition for passengers.

In one or more embodiments, the elevator car 304 can have a near field communication (NFC) transceiver affixed to it to communicate with the user device 324 that has a corresponding NFC transceiver. The user device 324 can transmit signals to the controller 302 to indicate the passenger can access restricted floors and the projection of the car operating panel 314 can display virtual elements corresponding to the restricted floors for the passenger.

In one or more embodiments, the database 322 can store new themes and software updates that can be transmitted to the controller 302 to update the care operating panel 314 in the elevator car 304.

In one or more embodiments, the camera 310 utilizing image recognition techniques can determine physical features of a passenger to project the car operating panel 314 at a location that is convenient for the passenger. For example, passengers that are shorter might require the car operating panel 314 to be projected at a lower location in the elevator car 304 for ease of use.

Figure 6:
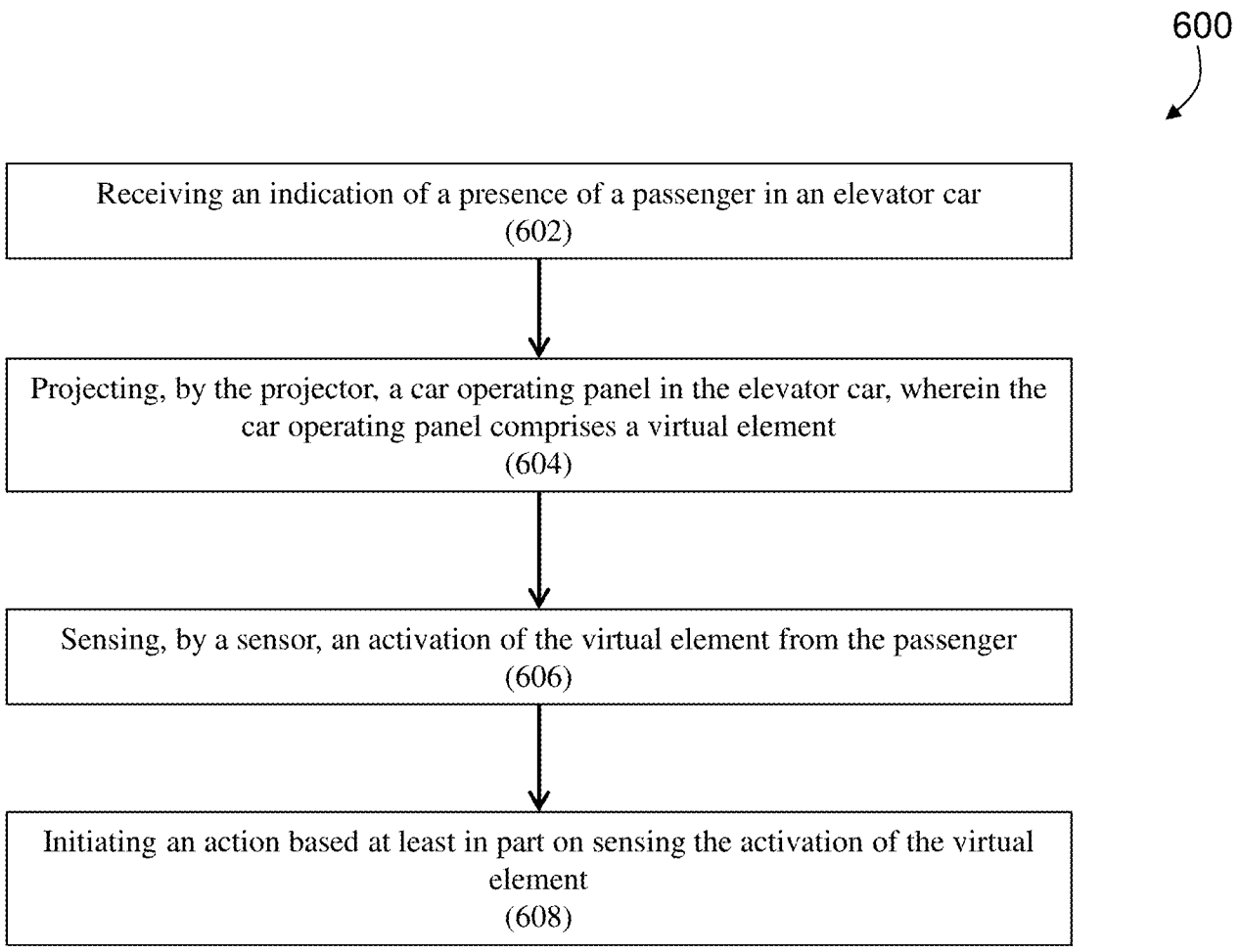
FIG. 6 depicts a flow diagram of a method for operating an elevator system according to one or more embodiments of the disclosure.

FIG. 6 depicts a flow diagram of a method for inspecting an elevator system according to one or more embodiments. The method 600 includes receiving an indication of a presence of a passenger in an elevator car, as shown at block 602. At block 604, the method 600 includes projecting, by the projector, a car operating panel in the elevator car, wherein the car operating panel comprises a virtual element. The method 600 then includes sensing, by a sensor, an activation of the virtual element from the passenger, as shown at block 606. And at block 608, the method 600 includes initiating an action based at least in part on sensing the activation of the virtual element.

Additional processes may also be included. It should be understood that the processes depicted in FIG. 6 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

an elevator car, a sensor, and a projector affixed to the elevator car, wherein the projector is operated by a controller; and wherein the controller is configured to:

receive an indication of a presence of a passenger in the elevator car;

project, by the projector, a car operating panel in the elevator car, wherein the car operating panel comprises a virtual element;

sense, by the sensor, an indication of a selection of the virtual element by the passenger;

determine a confidence level for the indication, wherein based on the confidence level being below a confidence threshold alerting the passenger to adjust the selection; and initiate an action based at least in part on sensing the activation of the virtual element.

2. The elevator system of claim 1, the action comprises: initiating an elevator command for the elevator car.

3. The elevator system of claim 1, the action comprises:

adding, by the controller, a second virtual element to the car operating panel; and projecting, by the projector, the second virtual element in the car operating panel.

4. The elevator system of claim 1, wherein the activation of the virtual element from the passenger comprises:

engaging, by the passenger, a region in the virtual element for a duration of time.

5. The elevator system of claim 1, wherein the activation of the virtual element from the passenger comprises:

engaging, by the passenger, a region in the virtual element utilizing a movement pattern.

6. The elevator system of claim 1, wherein the virtual element comprises a first color; and responsive to sensing the activation of the virtual element from the passenger, the virtual element changes to a second color.

7. The elevator system of claim 1, wherein the controller is further configured to:

periodically detect, by the sensor, the presence of the passenger; and responsive to the passenger exiting the elevator car, initiating a power savings mode for the car operating panel.

8. The elevator system of claim 1, wherein the car operating panel is projected on to a surface of the elevator car.

9. The elevator system of claim 1, wherein the car operating panel comprises a first mode and a second mode;

wherein the first mode comprises a minimal display of the virtual element; and wherein the second mode comprises a descriptive display of the virtual element.

10. The elevator system of claim 9, wherein the initiating the action comprises projecting, by the projector, the second mode for the car operating panel.

11. The elevator system of claim 1, wherein the controller is further operable to:

determine a location of the passenger in the elevator car; and wherein the car operating panel is projected to a second location proximate to the location of the passenger.

12. The elevator system of claim 1, wherein the car operating panel further comprises a news feed.

13. The elevator system of claim 1 further comprising a microphone, wherein the microphone is operated by the controller; and wherein the controller is further configured to:

receive an audio command from the user; and responsive to the audio command from the user, initiate a second action for the elevator car.

14. A computer-implemented method for operating an elevator system comprising:

receiving an indication of a presence of a passenger in an elevator car;

projecting, by the projector, a car operating panel in the elevator car, wherein the car operating panel comprises a virtual element;

sensing, by a sensor, an indication of a selection of the virtual element by the passenger;

determining a confidence level for the indication, wherein based on the confidence level being below a confidence threshold alerting the passenger to adjust the selection; and initiating an action based at least in part on sensing the activation of the virtual element.

15. The method of claim 14, wherein initiating the action comprises initiating an elevator command for the elevator car.

16. The method of claim 14, wherein initiating the action comprises:

adding a second virtual element to the car operating panel; and projecting, by the projector, the second virtual element in the car operating panel.

17. The method of claim 14, wherein the activation of the virtual element from the passenger comprises:

engaging, by the passenger, a region in the virtual element for a duration of time.

18. The method of claim 14, wherein the activation of the virtual element from the passenger comprises:

engaging, by the passenger, a region in the virtual element utilizing a movement pattern.

19. The method of claim 14, wherein the virtual element comprises a first color; and responsive to sensing the activation of the virtual element from the passenger, the virtual element changes to a second color.

20. The method of claim 14 further comprising:

periodically detecting, by the sensor, the presence of the passenger; and responsive to the passenger exiting the elevator car, initiating a power savings mode for the car operating panel.

* * * * *